US010066614B2

(12) United States Patent
Kadoguchi et al.

(10) Patent No.: US 10,066,614 B2
(45) Date of Patent: Sep. 4, 2018

(54) VARIABLE DISPLACEMENT TYPE SWASH PLATE COMPRESSOR

(71) Applicant: KABUSHIKI KAISHA TOYOTA JIDOSHOKKI, Aichi (JP)

(72) Inventors: Kenichi Kadoguchi, Aichi-ken (JP); Norihisa Tamada, Aichi-ken (JP); Masashi Nakamori, Aichi-ken (JP); Yoshio Kimoto, Aichi-ken (JP); Ryo Matsubara, Aichi-ken (JP)

(73) Assignee: KABUSHIKI KAISHA TOYOTA JIDOSHOKKI, Aichi (JP)

( * ) Notice: Subject to any disclaimer, the term of this patent is extended or adjusted under 35 U.S.C. 154(b) by 176 days.

(21) Appl. No.: 15/353,096

(22) Filed: Nov. 16, 2016

(65) Prior Publication Data

US 2017/0146009 A1 May 25, 2017

(30) Foreign Application Priority Data

Nov. 20, 2015 (JP) ..... 2015-227391

(51) Int. Cl.
*F04B 27/10* (2006.01)
*F04B 27/08* (2006.01)
(Continued)

(52) U.S. Cl.
CPC ..... *F04B 27/1009* (2013.01); *F04B 27/0878* (2013.01); *F04B 27/1027* (2013.01);
(Continued)

(58) Field of Classification Search
CPC .. F04B 27/10; F04B 27/1009; F04B 27/1018; F04B 27/1027; F04B 27/1036;
(Continued)

(56) References Cited

U.S. PATENT DOCUMENTS 5,232,349 A * 8/1993 Kimura ..... F04B 27/1018 417/222.1
5,616,008 A * 4/1997 Yokono ..... F04B 27/1036 417/222.2

(Continued)

FOREIGN PATENT DOCUMENTS

JP 2014-125993 7/2014
JP 2015-68187 4/2015

*Primary Examiner* — Kenneth J Hansen
*Assistant Examiner* — Chirag Jariwala
(74) *Attorney, Agent, or Firm* — Greenblum & Bernstein, P.L.C.

(57) ABSTRACT

A variable displacement type swash plate compressor includes a housing having therein a suction chamber, a discharge chamber, a control pressure chamber, a shaft hole, and cylinder bores. The compressor further has a drive shaft, a swash plate, an inclination angle changing mechanism, pistons, introduction passages, and a valve mechanism. The valve mechanism includes a valve element is disposed in a passage connecting the control pressure chamber and the suction chamber. The valve element is integrally rotatable with the drive shaft and axially movable by a pressure difference across the valve element. An opening of the residual gas bypass passage is changed by the axial movement of the valve element. The valve element selectively connects and disconnects the introduction passages with the residual gas bypass passage.

6 Claims, 9 Drawing Sheets

(51) Int. Cl.
*F04B 27/18* (2006.01)
*F04B 49/12* (2006.01)
*F04B 49/24* (2006.01)

(52) U.S. Cl.
CPC ..... *F04B 27/1045* (2013.01); *F04B 27/18* (2013.01); *F04B 27/1804* (2013.01); *F04B 49/125* (2013.01); *F04B 49/24* (2013.01); *F04B 2027/1813* (2013.01); *F04B 2027/1827* (2013.01)

(58) Field of Classification Search
CPC ..... F04B 27/1045; F04B 27/1081; F04B 27/1804; F04B 2027/1809; F04B 2027/1827; F04B 2027/1831; F04B 2027/1836; F04B 2027/184; F04B 2027/1845; F04B 2027/1854; F04B 39/0027; F04B 39/0055; F04B 39/08; F04B 39/10; F04B 39/123; F04B 7/0003; F04B 7/0011; F04B 7/0015; F04B 53/06; F04B 49/24; F01B 3/00005; F01B 3/0008; F01B 3/0011; F01B 3/02
USPC ..... 417/221.1, 222.2, 269, 270
See application file for complete search history.

(56) References Cited

U.S. PATENT DOCUMENTS

| | | | | |
|---|---|---|---|---|
| 9,470,224 | B2 * | 10/2016 | Ban | F04B 27/1018 |
| 2005/0196291 | A1 * | 9/2005 | Inoue | F04B 27/10 417/269 |
| 2015/0093263 | A1 | 4/2015 | Kimoto et al. | |

* cited by examiner

VARIABLE DISPLACEMENT TYPE SWASH PLATE COMPRESSOR

BACKGROUND OF THE INVENTION

The present invention relates to a variable displacement type swash plate compressor.

Japanese Patent Application Publication 2014-125993 discloses a variable displacement type swash plate compressor including a cylinder block, a front housing and a rotary shaft extending through the center of a swash plate chamber that is formed by the cylinder block and the front housing. The rotary shaft is rotatably supported by a radial bearing in the front housing. The cylinder block has therein at the center thereof a valve receiving hole in which a rotary valve is fittedly inserted. The rotary valve is mounted on the rotary shaft for rotation therewith. The rotary valve includes a small diameter portion that is press-fitted in a hole formed in the drive shaft and a large diameter portion that has therein a guide chamber. A plurality of guide holes is formed through the peripheral surface of the large diameter portion in communication with the guide chamber. The guide holes are spaced at 180 degree interval in the circumferential direction of the rotary valve. The guide chamber and the guide holes of the rotary valve cooperate to form a rotary valve passage. The rotary valve passage is connected to communication passages which are connected to cylinder bores successively with the rotation of the rotary valve. The communication passages are connected to the guide chamber through the guide holes.

According to the compressor of the above-cited publication, blowby gas leaking from one of compression chambers is guided through an annular groove, a straight groove, a communication passage and the guide hole and stored in the guide chamber temporarily. The blowby gas is flowed through the guide hole and another communication passage into another compression chamber for collection of refrigerant gas. Such structure is adaptable to various displacement and may effectively reduce blowby gas leaking into the swash plate chamber at various displacement of the compressor.

Japanese Patent Application Publication 2015-68187 discloses another variable displacement type swash plate compressor that has a collection-and-supply mechanism. The collection-and-supply mechanism includes a plurality of collection passages, a plurality of supply passages, an annular space, an inlet port and an outlet port. The inlet port is communicable with one of the collection passages which is working actually at the time. The outlet port is communicable with one of the collection passages which is working at the time. In this compressor, when the inclination angle of the swash plate is at the maximum, the residual refrigerant gas in the compression chamber is collected by the working collection passage and then is supplied to the other compression chamber. In this compressor, however, the supply of the residual refrigerant gas to the other compression chamber does not take place when the inclination angle of the swash plate is less than the maximum.

According to the compressor disclosed in the publication 2014-125993, there is a fear that noise occurs by the effect of the pressure waveform in the cylinder bore, though the blowby gas leaking out from one compression chamber may be collected by another compression chamber in the intermediate displacement operation. Additionally, collection of blowby gas may heat suction gas thereby to increase the power required for compression, with the result that the coefficient of performance (COP) of the compressor may be deteriorated.

According to the compressor disclosed in the publication 2015-68187, on the other hand, noise is not generated by effect of the pressure waveform because the residual refrigerant gas is not supplied to the other compression chamber when the inclination angle of the swash plate is less than the maximum. However, there is a fear that refrigerant gas in the working collection passage may leak between the piston and the cylinder block into a crank chamber (control pressure chamber) because the connection between the working collection passage and the other compression chamber is shut off when the inclination angle of the swash plate is less than the maximum. In order to prevent the leakage of the refrigerant gas, hermeticity between the piston and the cylinder bore needs to be enhanced.

The present invention, which has been made in light of the above-described problems, is directed to providing a variable displacement type swash plate compressor that can prevent noise and leakage of a refrigerant gas from a cylinder bore to a control pressure chamber when the displacement of the compressor is changed.

SUMMARY OF THE INVENTION

In accordance with an aspect of the present invention, there is provided a variable displacement type swash plate compressor including a housing having therein a suction chamber, a discharge chamber, a control pressure chamber in communication with the suction chamber, a shaft hole, and a plurality of cylinder bores disposed around the shaft hole. The compressor further includes a drive shaft inserted into the shaft hole and rotatably supported in the housing, a swash plate accommodated in the control pressure chamber and rotatable with the drive shaft, an inclination angle changing mechanism permitting changing of an inclination angle of the swash plate with respect to an imaginary plane extending perpendicular to an axis of the drive shaft. The compressor yet further includes a plurality of pistons received in the respective cylinder bores and connected to the swash plate, the pistons being reciprocally movable with the rotation of the drive shaft, a plurality of introduction passages connecting the shaft hole and the respective cylinder bores, and a valve mechanism having a residual gas bypass passage that introduces a high-pressured residual gas in one of the cylinder bores into another of the cylinder bores having a pressure lower than the one of the cylinder bores through the introduction passages. The valve mechanism has a valve element that is mounted to the drive shaft and is disposed in a passage connecting the control pressure chamber and the suction chamber. The valve element is integrally rotatable with the drive shaft and movable in a direction of the axis of the drive shaft by a pressure difference across the valve element. An opening of the residual gas bypass passage is changed by the movement of the valve element in the direction of the axis of the drive shaft. The valve element selectively connects and disconnects the introduction passages with the residual gas bypass passage with the rotation of the drive shaft.

DETAILED DESCRIPTION OF THE EMBODIMENTS

The following will describe a variable displacement type swash plate compressor according to a first embodiment of the present invention with reference to the accompanying drawings. The variable displacement type swash plate compressor (hereinafter simply referred to as the compressor) according to the present embodiment is mounted in a vehicle and used for a vehicle air conditioner. It is noted that the left and the right in longitudinal direction of the compressor shown in FIG. 1 will be referred to the front and rear sides of the compressor, respectively.

Figure 1:
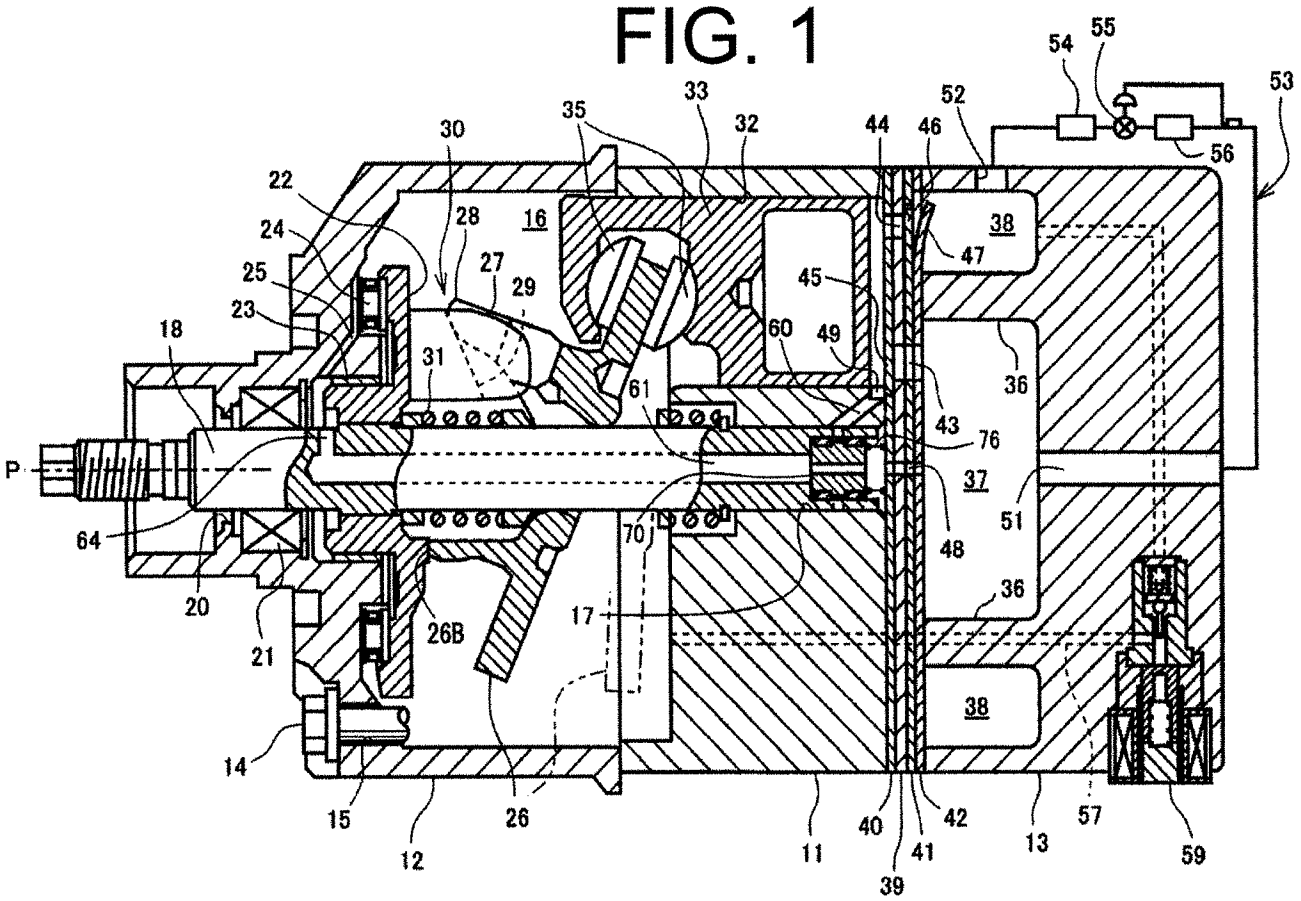
FIG. 1 is a longitudinal sectional view of a variable displacement type swash plate compressor according to a first embodiment of the present invention.

Referring to FIG. 1, the compressor includes a cylinder block 11, a front housing member 12 and a rear housing member 13 that are connected to the front end and rear end of the cylinder block 11, respectively. The cylinder block 11, the front housing member 12 and the rear housing member 13 are connected to each other by bolts 14 having a male threaded portion (only one bolt shown in FIG. 1), respectively. The cylinder block 11 has bolt holes (not shown) through which the bolts 14 are inserted, and the front housing member 12 has bolt holes 15. The rear housing member 13 has bolt holes having a female threaded portion (not shown), respectively, into which the male threaded portion of the bolt 14 is screwed. The cylinder block 11, the front housing member 12 and the rear housing member 13 cooperate to form the housing of the compressor.

A control pressure chamber 16 is formed in the front housing member 12 by joining the front housing member 12 and the cylinder block 11. The cylinder block 11 has a shaft hole 17 into which a drive shaft 18 is inserted, and the drive shaft 18 is rotatably supported in the cylinder block 11. In the present embodiment, a coating layer containing a lubricant is formed on the outer peripheral surface of the drive shaft 18 that is in sliding contact with the cylinder block 11. The front housing member 12 has a shaft hole 20 through which the drive shaft 18 is inserted. A shaft sealing device 21 is disposed in the shaft hole 20. A lip seal which is made of a rubber as a main material is used for the shaft sealing device 21. The front end of the drive shaft 18 projects out from the control pressure chamber 16 and receives driving force from an external power source (not shown) such as an engine.

A rotary support member 22 is fixedly mounted on the drive shaft 18 for rotation therewith. The rotary support member 22 is rotatably supported by the front housing member 12 via a radial bearing 23. A thrust bearing 24 is interposed between the rotary support member 22 and the bottom wall of the front housing member 12 so as to receive a load applied in a direction of the axis P of the drive shaft 18. An oil passage 25 is formed in the front housing member 12. The oil passage 25 extends from radially outer region of the control pressure chamber 16 along the thrust bearing 24 and between the front housing member 12 and the rotary support member 22 and reaches the shaft hole 20. A swash plate 26 is supported by the rotary support member 22 so as to be slidable along and tiltable with respect to the direction of the axis P of the drive shaft 18. The swash plate 26 is accommodated in the control pressure chamber 16.

The rotary support member 22 includes a pair of arms 27 (only one arm shown in FIG. 1) extending towards the swash plate 26, and the swash plate 26 includes a pair of projections 28 extending towards the rotary support member 22. The projections 28 of the swash plate 26 are disposed and movable in a recess defined by the paired arms 27 of the rotary support member 22. The arm 27 has a cam surface 29 at the bottom of the recess, and the distal end of the projection 28 is movable in sliding contact with the cam surface 29.

The projection 28 disposed between the paired arms 27 cooperates with the cam surface 29, so that the swash plate 26 is tiltable relative to the axis P of the drive shaft 18 and rotatable with the drive shaft 18. The tilting movement of the swash plate 26 is guided by the sliding contact, or slide-guide relation, between the cam surface 29 and the projection 28 as well as the support of the drive shaft 18 with which the swash plate 26 slides. The paired arms 27, the projections 28 and the cam surface 29 cooperate to form an inclination angle changing mechanism 30 that is provided between the swash plate 26 and the rotary support member 22. The inclination angle changing mechanism 30 connects the drive shaft 18 and the swash plate 26 together so as to permit change of the inclination angle of the swash plate 26 with respect to an imaginary plane extending perpendicular to the axis P of the drive shaft 18 and to transmit of torque of the drive shaft 18 to the swash plate 26. A coil spring 31 is fittedly mounted on the drive shaft 18 The coil spring 31 is positioned between the rotary support member 22 and the swash plate 26 so as to urge the swash plate 26 away from the rotary support member 22.

When the swash plate 26 is moved along the axis P so that its radial center is moved towards the rotary support member 22, the inclination angle of the swash plate 26 with respect to the imaginary plane is increased. The maximum inclination angle of the swash plate 26 is determined by the contact between the rotary support member 22 and an engaging portion 26B of the swash plate 26. In FIG. 1, the maximum inclination angle position and the minimum inclination angle position of the swash plate 26 are indicated by solid line and chain double-dashed line, respectively.

The cylinder block 11 has therein a plurality of cylinder bores 32 disposed around the shaft hole 17. A plurality of pistons 33 is reciprocally movably received in the respective cylinder bores 32. Each piston 33 is connected to the swash plate 26 via a pair of shoes 35. The rotation of the swash plate 26 is converted to the reciprocating movement of the piston 33 by way of the pair of shoes 35, so that the piston 33 is reciprocally movable in the cylinder bore 32.

The rear housing member 13 has therein a suction chamber 37 and a discharge chamber 38 which are partitioned by a partitioning wall 36. A valve plate 39, valve forming plates 40, 41, a retainer forming plate 42 are interposed between the cylinder block 11 and the rear housing member 13. A suction port 43 is formed through the valve plate 39, the valve forming plate 41 and the retainer forming plate 42. A discharge port 44 is formed through the valve plate 39 and the valve forming plate 40. The valve forming plate 40 has a suction valve 45 and the valve forming plate 41 has a discharge valve 46. A retainer 47 that restricts the opening of the discharge valve 46 is formed in the retainer forming plate 42.

Figure 2:
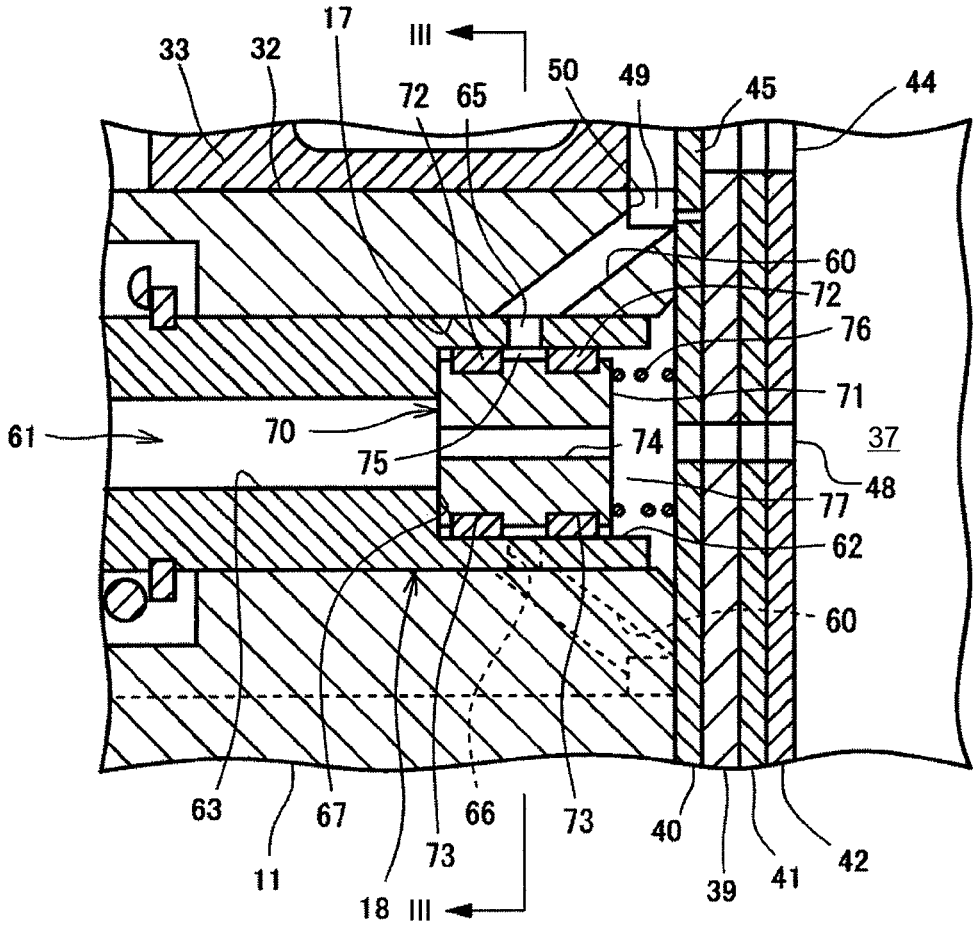
FIG. 2 is a partially enlarged longitudinal sectional view of the compressor of FIG. 1.

The valve plate 39, the valve forming plates 40, 41 and the retainer forming plate 42 have at the center thereof a hole 48 through which the shaft hole 17 and the suction chamber 37 are connected. As shown in FIG. 2, a space 49 is formed by cutting out a part of the cylinder block 11 adjacent to the inner peripheral surface of the cylinder bore 32 near the drive shaft 18, at a position facing the valve forming plate 40. Thus, the cylinder bore 32 is communicated with the space 49 and the shaft hole 17. The opening degree of the suction valve 45 is restricted by the end surface 50 of the cylinder block 11 which defines the space 49.

With the frontward movement of the piston 33 (leftward in FIG. 1), refrigerant gas in the suction chamber 37 is drawn through the suction port 43 into the cylinder bore 32 while pushing open the suction valve 45. With the rearward movement of the piston 33 (rightward in FIG. 1), the refrigerant gas in the cylinder bore 32 pushes open the discharge valve 46 and is discharged through the discharge port 44 into the discharge chamber 38. The opening of the discharge valve 46 is restricted by the retainer 47 formed in the retainer forming plate 42.

As shown in FIG. 1, refrigerant gas is introduced into the suction chamber 37 through a suction passage 51 and is discharged out from the discharge chamber 38 through a discharge passage 52 after compression. The suction passage 51 and the discharge passage 52 are connected to an external refrigeration circuit 53. The external refrigeration circuit 53 is provided with a condenser 54 for cooling the refrigerant gas, an expansion valve 55, and an evaporator 56 for transferring heat from the ambient to the refrigerant gas. The expansion valve 55 controls the flow rate of refrigerant gas in response to the change of the refrigerant gas temperature at the exit of the evaporator 56. The refrigerant gas discharged into the discharge chamber 38 is flowed out through the discharge passage 52 into the external refrigeration circuit 53 and flowed back into the suction chamber 37 through the suction passage 51. The discharge chamber 38 and the control pressure chamber 16 are connected through a feeding passage 57.

A displacement control valve 59 is disposed in the rear housing member 13 so as to control the flow rate of refrigerant gas passing through the feeding passage 57. The pressure in the control pressure chamber 16 is increased with an increase of the flow rate of refrigerant gas passing through the feeding passage 57 which is controlled by the opening of the displacement control valve 59. Accordingly, the inclination angle of the swash plate 26 is reduced. When the flow rate of the refrigerant gas passing through the feeding passage 57 is reduced by reducing the opening of the displacement control valve 59, the pressure in the control pressure chamber 16 is reduced, with the result that the inclination angle of the swash plate 26 is increased.

Figure 3:
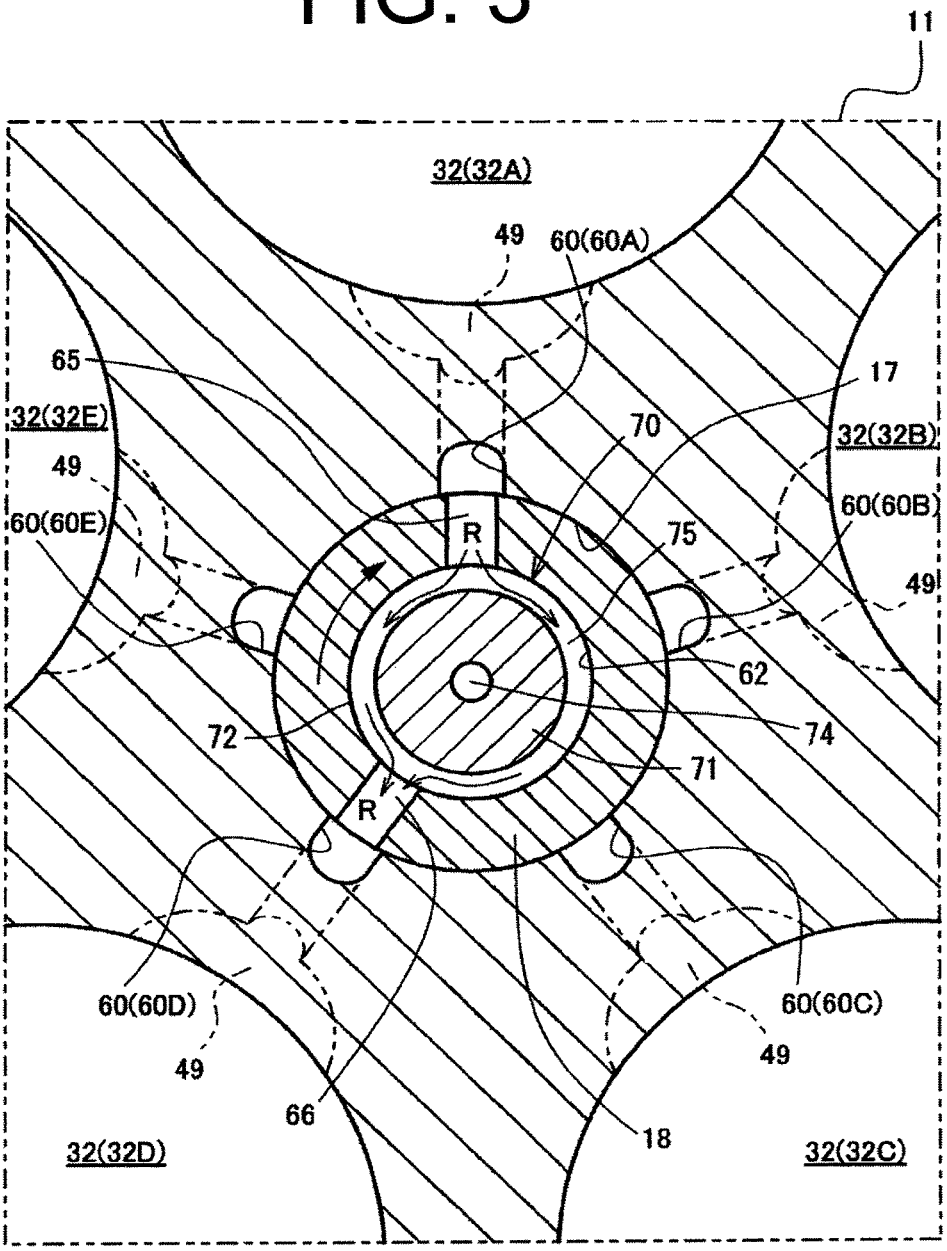
FIG. 3 is a cross-sectional view taken along line of FIG. 2.

The compressor of the present embodiment has a residual gas bypass passage through which high-pressured residual refrigeration gas (hereinafter referred to as high-pressured residual gas) remaining in one of the cylinder bores 32 after the discharge phase operation is flowed to another of the cylinder bores 32 having a low pressure. As shown in FIG. 3, in the cylinder block 11, a plurality of introduction passages 60 is formed so as to connect the shaft hole 17 and the space 49 for each cylinder bore 32. Referring to FIG. 3, the cylinder bores 32 are designated by 32A, 32B, 32C, 32D, 32E, and the introduction passages 60 for the respective cylinder bores by 60A, 60B, 60C, 60D, 60E. For the sake of illustration, the pistons 33 are not shown in FIG. 3. The number of the introduction passages 60 corresponds to the number of the cylinder bores 32. The introduction passages 60 are configured to connect the shaft hole 17 to their corresponding cylinder bore 32. The introduction passages 60 are formed extending radially in the cylinder block 11. As shown in FIGS. 1 and 2, the introduction passage 60 is inclined in such a way that one end of the introduction passage 60 that is opened to the space 49 is located near the valve plate 39, while the other end of the introduction passage' 60 that is opened to the shaft hole 17 is located closer to the control pressure chamber 16 than the one end of the introduction passage 60.

The drive shaft 18 has therein an in-shaft passage 61 disposed in the drive shaft 18 and extending along the axis P of the drive shaft 18. The in-shaft passage 61 extends from one end of the drive shaft 18, which is disposed adjacently to the rear housing member 13, toward the front housing member 12. As shown in FIG. 2, the in-shaft passage 61 has a large-diameter hole portion 62 formed adjacently to the one end of the drive shaft 18 and a small-diameter hole portion 63 formed with a diameter that is smaller than that of the large-diameter hole portion 62. The small-diameter hole portion 63 extends from the large-diameter hole portion 62 toward the other end of the drive shaft 18. A step surface 67 is formed between the large-diameter hole portion 62 and the small-diameter hole portion 63.

As shown in FIG. 1, the end of the small-diameter hole portion 63 on the side adjacent to the front housing member 12 is positioned between the shaft sealing device 21 and the rotary support member 22 as seen in the direction of the axis of the drive shaft 18. The drive shaft 18 has a hole 64 that extends radially from the front end of small-diameter hole portion 63 and is opened at the outer periphery of the drive shaft 18. The hole 64 is connected to the oil passage 25 via the shaft hole 20. Thus, the control pressure chamber 16 and the suction chamber 37 are connected through the hole 48, the in-shaft passage 61 and the hole 64. The refrigerant gas in the control pressure chamber 16 is flowed through the hole 48, the in-shaft passage 61 and the hole 64 into the suction chamber 37. The hole 48, the in-shaft passage 61 and the hole 64 serve as an oil passage, and also serve as a bleeding passage, which controls the pressure in the control pressure chamber 16 in cooperation with the displacement control valve 59 and the feeding passage 57.

Figure 4:
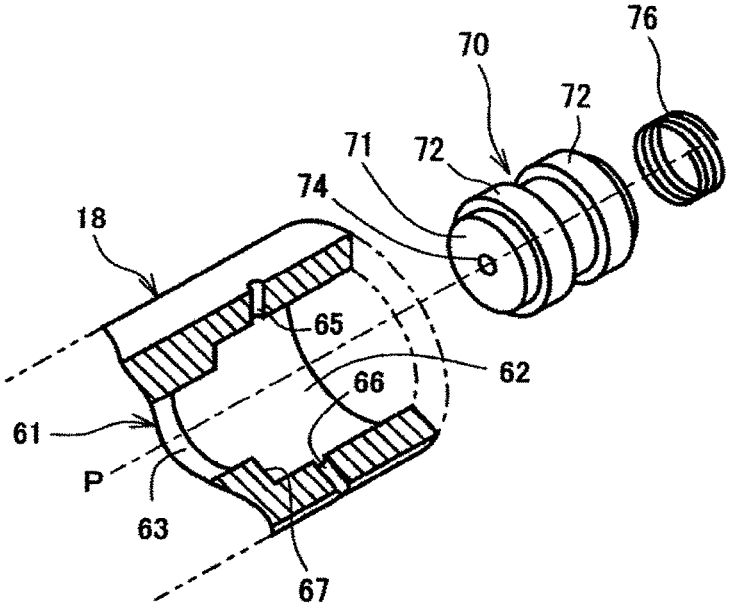
FIG. 4 is a perspective view of a valve element of the compressor according to the first embodiment of FIG. 1.

As shown in FIGS. 2 through 4, the drive shaft 18 has therein a high-pressure communication hole 65 and a low-pressure communication hole 66 that extend radially from the large-diameter hole portion 62 of the in-shaft passage 61 and are opened at the outer periphery of the drive shaft 18. The high-pressure communication hole 65 and the low-pressure communication hole 66 are disposed so as to be brought into communication with the introduction passages 60 of the cylinder bores 32 during the operation of the compressor. According to the present embodiment, as shown in FIG. 3, when the high-pressure communication hole 65 communicates with the introduction passage 60 (60A) of the cylinder bore 32 (32A), the low-pressure communication hole 66 communicates with the introduction passage 60 (60D) of the cylinder bore 32 (32D).

A valve element 70 is inserted in the in-shaft passage 61 from the side thereof adjacent to the rear housing member 13. The valve element 70 includes a main body 71 of a cylindrical shape having an outer diameter so as to be insertable into the large-diameter hole portion 62 of the in-shaft passage 61. A pair of annular seal members 72 is mounted in a pair of annular grooves 73 formed in the outer peripheral surface of the main body 71 of the valve element 70. The annular seal member 72 is an O-ring made of a rubber. With the valve element 70 accommodated in the large-diameter hole portion 62, the outer peripheral surface of the annular seal member 72 is in sliding contact with the drive shaft 18, and the valve element 70 is reciprocally movable in the direction of the axis of the drive shaft 18 in the large-diameter hole portion 62. The dimension of the annular seal member 72 in the direction of axis of the drive shaft 18 is greater than the diameters of the high-pressure communication hole 65 and the low-pressure communication hole 66 so that the high-pressure communication hole 65 and the low-pressure communication hole 66 may be closed by the annular seal member 72 when the valve element 70 is moved toward the rear housing member 13. The annular seal member 72 permits the slide movement of the valve element 70 relative to the drive shaft 18 while sealing between the valve element 70 and the drive shaft 18.

With the valve element 70 movably inserted in the in-shaft passage 61, an annular space 75 is defined coaxially with the valve element 70 around the outer peripheral surface of the main body 71 between the paired annular seal members 72. The annular space 75 is communicable with the high-pressure communication hole 65 and the low-pressure communication hole 66. The high-pressure communication hole 65 and the low-pressure communication hole 66 correspond to the plurality of communication passages that provides communication between the annular space 75 and the introduction passages 60. The annular space 75, the high-pressure communication hole 65 and the low-pressure communication hole 66 cooperate to form the residual gas bypass passage. Through the residual gas bypass passage, residual refrigerant gas from one of the cylinder bores 32 in which the discharge phase operation is completed is introduced to another of the cylinder bores 32 in which the compression phase operation is taking place.

The valve element 70 has a valve hole 74 that extends axially through the main body 71 and is opened at the opposite end surfaces. The diameter of the valve hole 74 is smaller than those of the in-shaft passage 61 and the hole 48. A space 77 is defined in the shaft hole 17 by the end surface of the valve element 70. The space 77 is opened to the hole 48. The valve hole 74 provides a fluid communication between the in-shaft passage 61 and the space 77. Since the space 77 is in communication with the suction chamber 37 through the hole 48, the space 77 has a pressure corresponding to the suction pressure. The valve hole 74 serves as a throttle hole. That is, the valve holes 74 serves as a part of the bleeding passage, especially as a throttle hole of the bleeding passage, as well as a part of the oil passage. The hole 48, which also serves as a throttle hole, is configured to differentiate the pressures applied on the opposite end surfaces of the valve element 70 and set the pressure difference so as to control the reciprocal movement of the valve element 70. The end surface of the valve element 70 facing the small-diameter hole portion 63 is subjected to the pressure PC in the control pressure chamber 16 and the end surface of the valve element 70 facing the valve forming plate 40 is subjected to the suction pressure PS.

A coil spring 76 is provided between the valve forming plate 40 and the valve element 70. The coil spring 76 is a compression spring urging the valve element 70 towards the step surface 67 of the drive shaft 18. When there is no significant pressure difference between the pressure PC in the control pressure chamber 16 and the suction pressure PS, the valve element 70 is pressed to the step surface 67 by the urging force of the coil spring 76. When the pressure PC is greater than the suction pressure PS and generates a force greater than the urging force of the coil spring 76, the valve element 70 is moved away from the step surface 67 of the drive shaft 18 against the urging force of the coil spring 76. In other word, the valve element 70 is movable in the direction of the axis P of the drive shaft 18 by the pressure difference across the opposite sides of the valve element 70. A low friction coating is applied to the part of the coil spring 76 which is in contact with the valve element 70 so as to facilitate the sliding of the coil spring 76 relative to the valve element 70. Thus, the coil spring 76 is prevented from being rotated with the drive shaft 18.

The compressor of the present invention includes a valve mechanism that has the residual gas bypass passage and is integrally operable with the drive shaft 18 in the shaft hole 17. The valve mechanism is provided with the annular space 75 formed around the outer periphery of the valve element 70 in the in-shaft passage 61, the high-pressure communication hole 65 and the low-pressure communication hole 66. The valve mechanism is operable to selectively connect and disconnect the residual gas bypass passage with the introduction passages 60 in conjunction with the rotation of the drive shaft 18.

With the valve element 70 axially movably inserted, the annular space 75 and the small-diameter hole portion 63, which communicates with the valve hole 74 of the valve element 70, are separated in the in-shaft passage 61, and do not communicate mutually. In other words, the valve element 70 separates the residual gas bypass passage and the in-shaft passage 61 and makes the valve hole 74 of the valve element 70 to be opened to the in-shaft passage 61.

The following will describe the operation of the compressor according to the present embodiment. When the compressor starts its operation, refrigerant gas is introduced from the external refrigeration circuit 53 through the suction passage 51 into the suction chamber 37. During the suction phase, the piston 33 is moved from the top dead center towards the bottom dead center in the cylinder bore 32, and the suction valve 45 is opened thereby to introduce the refrigerant gas in the suction chamber 37 into the cylinder bore 32 through the suction port 43. The discharge valve 46 is kept in contact with the valve plate 39 thereby to close the discharge port 44 because of a reduced pressure in the cylinder bore 32 compared to a high pressure in the discharge chamber 38. During the subsequent compression phase operation, the piston 33 is moved from the bottom dead center towards the top dead center, with the result that the pressure in the cylinder bore 32 is increased to compress the refrigerant gas in the cylinder bore 32.

During the discharge phase operation, the discharge valve 46 is bent thereby to open the discharge port 44, so that the refrigerant gas in the cylinder bore 32 is discharged through the discharge port 44 into the discharge chamber 38. Simultaneously, the suction valve 45 is brought in contact with the valve plate 39 to close the suction port 43 because of a low pressure in the suction chamber 37 and an increased pressure in the cylinder bore 32. When the piston 33 is moved to the top dead center and the refrigerant gas in the cylinder bore 32 is discharged into the discharge chamber 38 to reduce the pressure in the cylinder bore 32, the discharge valve 46 is restored to its original shape by elastic restoration force retained by the bending of the discharge valve 47. Thus, the discharge valve 46 is moved away from the retainer 47 and closes the discharge port 44. The refrigerant gas discharged out from the cylinder bore 32 into the discharge chamber 38 is discharged to the external refrigeration circuit 53 via the discharge passage 52.

When the drive shaft 18 is rotated by the operation of the compressor, the swash plate 26 is rotated with the drive shaft 18. With the rotation of the swash plate 26, each piston 33 makes a reciprocal movement in its associated cylinder bore 32. When the piston 33 starts moving from the top dead center toward the bottom dead center in the cylinder bore 32, the suction phase operation takes place in the cylinder bore 32. When the piston 33 starts moving from the bottom dead center to the top dead center in the cylinder bore 32, the compression and discharge phase operation take place in the cylinder bore 32.

For example, in the state of the compressor shown in FIG. 3, the discharge phase operation in that the piston 33 is moved to the top dead center has completed and the suction phase is about to start in the cylinder bore 32 (32A). The cylinder bores 32 (32D, 32E) are in the compression phase in that their respective pistons 33 are moved towards the top dead center. The cylinder bores 32 (32B, 32C) are in the suction phase in that their respective pistons 33 are moved toward the bottom dead center.

During the operation of the compressor at the maximum displacement, the pressure PC in the control pressure chamber 16 is low and the inclination angle of the swash plate 26 with respect to an imaginary plane extending perpendicular to the axis P of the drive shaft 18 becomes maximum. As shown in FIG. 2, the valve element 70 is pressed to the step surface 67 at the maximum displacement. The pressure difference between the pressure PC in the control pressure chamber 16 and the suction pressure PS is small, so that the urging force of the coil spring 76 is greater than the force generated by the pressure difference to urge the valve element 70 away from the step surface 67. With the valve element 70 pressed to the step surface 67, the annular space 75 is in communication with the high-pressure communication hole 65 and the low-pressure communication hole 66. In other words, the residual gas bypass passage is communicated when the swash plate 26 is positioned at its maximum inclination angle. At the maximum displacement operation, the residual gas bypass passage is fully opened.

In the state of the compressor shown in FIG. 3, the valve mechanism causes the high-pressure communication hole 65 in the drive shaft 18 to be connected to the introduction passage 60 (60A) which is connected to the high-pressured cylinder bore 32 (32A). Simultaneously, the low-pressure communication hole 66 in the drive shaft 18 is connected to the introduction passage 60 (60D) which is connected to the low-pressured cylinder bore 32 (32D). Therefore, the high-pressured residual gas in the high-pressured cylinder bore 32 (32A) is drawn into the cylinder bore 32 (32D), flowing through the introduction passage 60 (60A), the annular space 75, the low-pressure communication hole 66 and the introduction passage 60 (60D). Referring to FIG. 3, the flow of refrigerant gas is indicated by arrows R. Part of the outer peripheral surface of the drive shaft 18 extending axially between the high-pressure communication hole 65 (low-pressure communication hole 66) and the control pressure chamber 16 is in sliding contact with the cylinder block 11 over the entire circumference of the drive shaft 18. That provides sealing to prevent the leakage of refrigerant gas from the shaft hole 17. Part of the outer peripheral surface of the drive shaft 18 extending axially between the high-pressure communication hole 65 (low-pressure communication hole 66) and the rear end of the drive shaft 18 is in sliding contact with the cylinder block 11 over the entire circumference of the drive shaft 18. That provides sealing and prevents the leakage of the refrigerant gas from the shaft hole 17. The outer peripheral surface of the annular seal member 72 of the valve element 70 is in sliding contact with the inner peripheral surface of the in-shaft passage 61 over the entire circumference thereof, thereby preventing the leakage of the refrigerant gas from the annular space 75.

The pressure in the cylinder bore 32 (32A) is reduced close to the suction pressure by introducing the high-pressured residual gas in the high-pressured cylinder bore 32 (32A) into the low-pressured cylinder bore 32 (32D). That causes the pressure in the cylinder bore 32 (32D) to be increased slightly greater than the suction pressure.

Then, with the rotation of the drive shaft 18 in clockwise direction, which is indicated by the arrow in FIG. 3, the valve mechanism causes the high-pressure communication hole 65 to be disconnected from the introduction passage 60 (60A) and the low-pressure communication hole 66 from the introduction passage 60 (60D). In such a state, the cylinder bore 32 (32A) and the cylinder bore 32 (32D) are not in communication with the high-pressure communication hole 65 and the low-pressure communication hole 66, respectively, and the suction phase operation takes place in the cylinder bore 32 (32A) while the compression phase operation takes place in the cylinder bore 32 (32D). With further rotation of the drive shaft 18, the valve mechanism causes the high-pressure communication hole 65 to be connected to the introduction passage 60 (60B) and the low-pressure communication hole 66 to be connected to the introduction passage 60 (60E). Thus, the high-pressured residual gas in the cylinder bore 32 (32B) is allowed into the cylinder bore 32 (32E), flowing through the introduction passage 60 (60B), the high-pressure communication hole 65, the annular space 75, the low-pressure communication hole 66 and the introduction passage 60 (60E).

Figure 5:
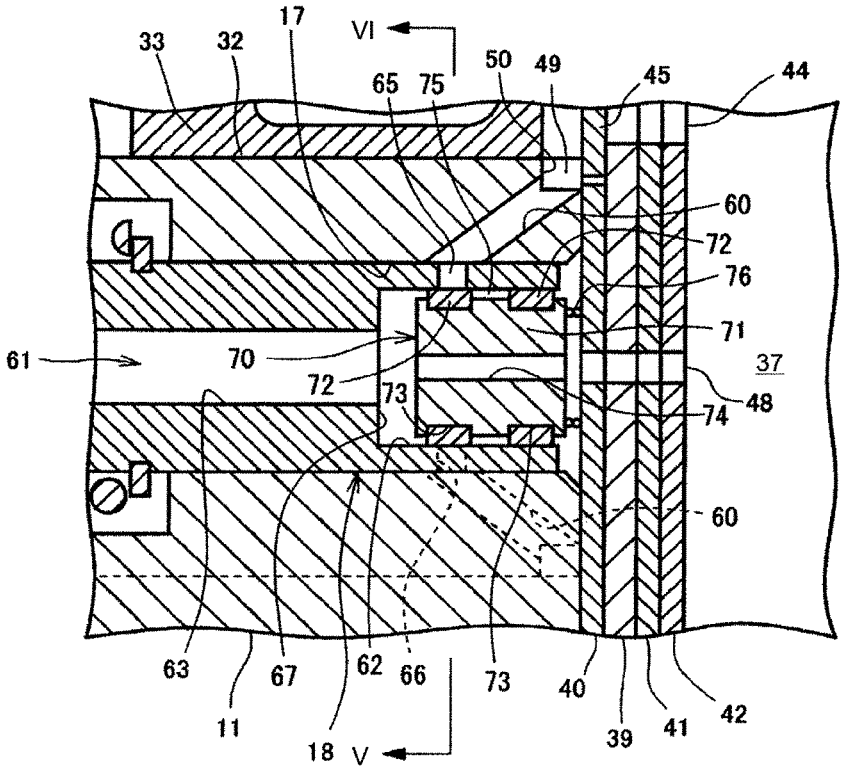
FIG. 5 is a partially enlarged longitudinal sectional view of the compressor of FIG. 1, showing its operation at an intermediate displacement.
Figure 6:
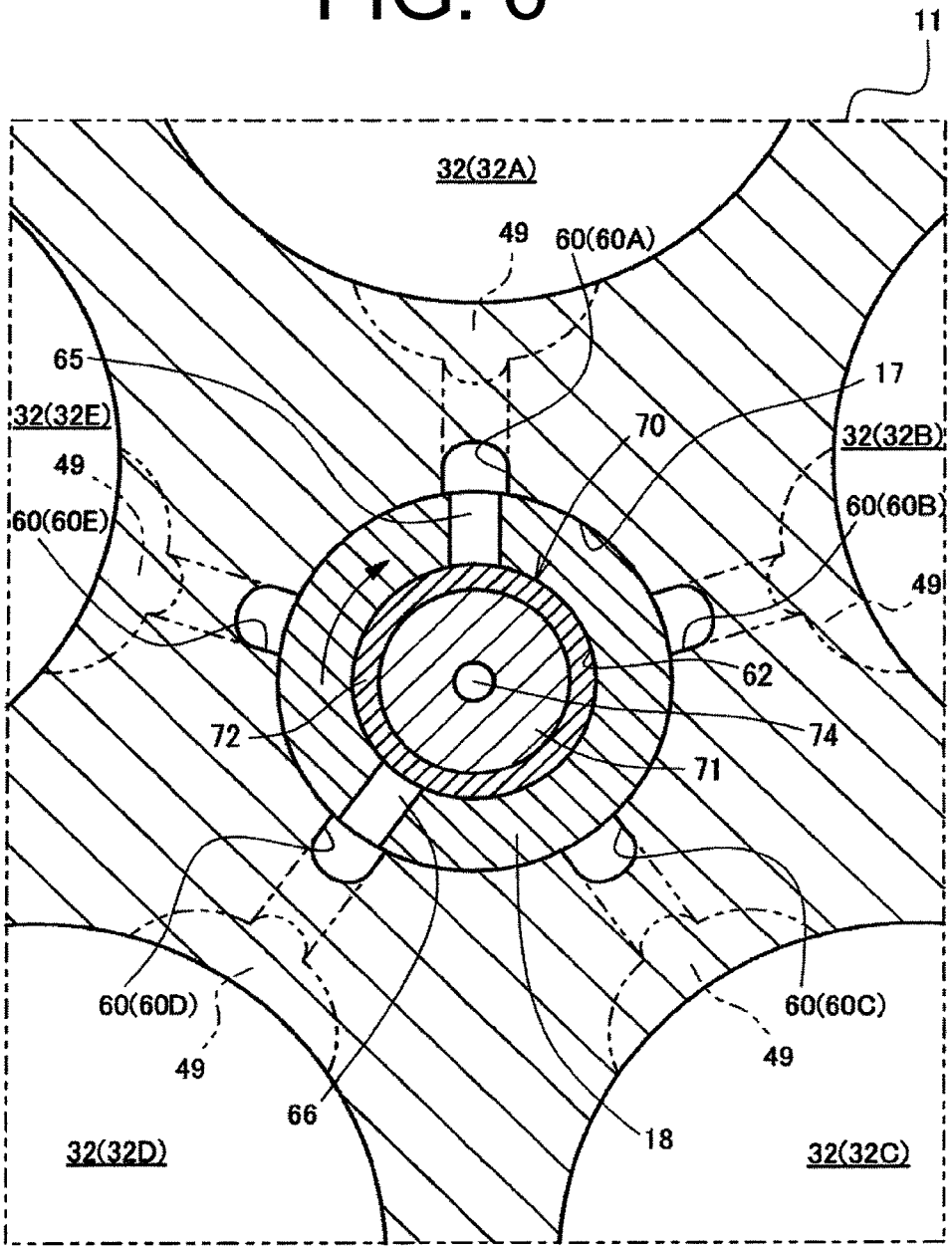
FIG. 6 is a cross-sectional view taken along line VI-VI of FIG. 5.

During the operation of the compressor at the minimum displacement, on the other hand, the pressure PC in the control pressure chamber 16 is high and the inclination angle of the swash plate 26 with respect to the imaginary plane extending perpendicular to the axis P of the drive shaft 18 becomes minimum. As shown in FIG. 5, the valve element 70 is moved to a position apart from the step surface 67. The pressure difference between the pressure PC in the control pressure chamber 16 and the suction pressure PS is increased due to the increased pressure in the control pressure chamber 16, so that the force generated by the pressure difference to urge the valve element 70 away from the step surface 67 becomes greater than the urging force of the coil spring 76. In this state, the pressure difference between the pressure PC in the control pressure chamber 16 and the suction pressure PS is at a specific set pressure or greater. With the valve element 70 positioned away from the step surface 67, the high-pressure communication hole 65 and the low-pressure communication hole 66 are closed by the annular seal member 72, respectively. Thus, the annular space 75 is in communication neither with the high-pressure communication hole 65 nor with the low-pressure communication hole 66, as shown in FIG. 6. In other words, the valve element 70 disconnects the residual gas bypass passage when the swash plate 26 is positioned at its minimum inclination angle. At the minimum displacement operation, the residual gas bypass passage is fully closed.

When the compressor is in the state shown in FIG. 6, the high-pressure communication hole 65 is connected to the introduction passage 60 (60A) in communication with the high-pressured cylinder bore 32 (32A). Simultaneously, the low-pressure communication hole 66 is connected to the introduction passage 60 (60D) in communication with the low-pressured cylinder bore 32 (32D). Since the residual gas bypass passage is closed, the high-pressured residual gas in the cylinder bore 32 (32A) only flows to the introduction passage 60 (60A). The residual gas bypass passage is communicable when the inclination angle of the swash plate 26 is at the maximum inclination angle and is incommunicable when the inclination angle of the swash plate 26 is at the specific angle or less, including the minimum inclination angle.

During the operation of the compressor at an intermediate displacement, or when the compressor is operated neither at the maximum nor at the minimum displacement, the position of the valve element 70 is also changed according to the pressure difference between the pressure PC in the control pressure chamber 16 and the suction pressure PS. When the pressure difference between the pressure PC in the control pressure chamber 16 and the suction pressure PS becomes at the specific pressure or greater, the valve element 70 shuts off the fluid communication between the introduction passages 60 and the residual gas bypass passage, so that the high pressured residual gas in the high-pressured cylinder bore 32 (32A) is not introduced into the low-pressured cylinder bore 32 (32D). Therefore, when the pressure difference between the pressure PC in the control pressure chamber 16 and the suction pressure PS is at the specific pressure or greater, the generation of noise and the deterioration of COP by the influence of the pressure waveform in the cylinder bores 32 and the leakage of refrigerant gas from the cylinder bores 32 to the control pressure chamber 16 do not occur.

During the operation of the compressor, the oil in the control pressure chamber 16 provides lubrication for sliding parts such as the radial bearing 23 and the thrust bearing 24. After lubrication of, for example, the thrust bearing 24, the oil passes through the oil passage 25 so as to cool the shaft sealing device 21 in the shaft hole 20. The oil in the hole 64 is flowed through the small-diameter hole portion 63 of the in-shaft passage 61 and the valve hole 74 of the valve element 70 and drawn into the suction chamber 37 through the hole 48.

The compressor of the present invention offers the following effects.

(1) The position of the valve element 70 may be changed by the pressure difference between the pressure PC in the control pressure chamber 16 and the suction pressure PS. When the pressure difference becomes at the specific pressure or greater, the valve element 70 shuts off fluid communication between the introduction passage 60 and the residual gas bypass passage. At the maximum displacement in that the swash plate 26 has its maximum inclination angle, the valve element 70 is positioned where it provides a fluid communication between the introduction passages 60 and the residual gas bypass passage, with the result that the high-pressured residual gas in the high-pressured cylinder bore 32 is introduced into the low-pressured cylinder bore 32. When the pressure difference between the pressure PC in the control pressure chamber 16 and the suction pressure PS is at the specific pressure or greater, that is, the inclination angle of the swash plate 26 is at the specific angle or less in the intermediate displacement, the valve element 70 is disposed at the position where it shuts off the communication between the introduction passages 60 and the residual gas bypass passage, with the result that the high-pressured residual gas in the high-pressured cylinder bore 32 is not introduced to the low-pressured cylinder bore 32. Therefore, when the compressor is operated in a state that causes the pressure difference between the pressure PC in the control pressure chamber 16 and the suction pressure PS to be at the specific pressure or greater, the influence of the waveform of pressure in the cylinder bore 32 is less likely to result in noise and the deterioration of the COP, and the leakage of the refrigerant gas from the cylinder bore 32 to the control pressure chamber 16 hardly occurs.

(2) The opening of the residual gas bypass passage, which is changed by the movement of the valve element 70, is variable in accordance with the displacement of the compressor in operation. The flow of the high-pressured residual gas passing through the residual gas bypass passage may be controlled in accordance with the displacement of the compressor.

(3) The valve element 70 is inserted into the in-shaft passage 61 formed in the drive shaft 18, and the drive shaft 18 has therein the high-pressure communication hole 65 and the low-pressure communication hole 66 through which the introduction passages 60 are communicable with the residual gas bypass passage. With the introduction passages 60 connected to the residual gas bypass passage through the high-pressure communication hole 65 and the low-pressure communication hole 66, the high-pressured residual gas in the high-pressured cylinder bore 32 may be guided to the low-pressured cylinder bore 32.

(4) The valve hole 74 that serves as the throttle hole is formed extending in the direction of the axis of the drive shaft 18 and is disposed coaxially with the in-shaft passage 61. The valve hole 74 serves as a hole that sets the pressure difference across the valve element 70 in the direction of the axis. The valve hole 74 also serves as a throttle in the bleeding passage which releases the refrigerant gas from the control pressure chamber 16 to the suction pressure region.

(5) The annular space 75 formed around the outer periphery of the valve element 70 is communicable with the introduction passages 60 depending on the position of the valve element 70 in the direction of the axis of the drive shaft 18. The annular space 75 extending around the entire circumference of the valve element 70 may be formed easily. In addition, the annular space 75 performs the function of the residual gas bypass passage even if the valve element 70 is slightly rotated relative to the drive shaft 18, so that no rotation restriction member is required to prevent the rotation of the valve element 70 relative to the drive shaft 18.

(6) The valve element 70 is formed with the paired annular seal members 72 that are spaced in the direction of the axis of the drive shaft 18 and mounted on the outer periphery of the valve element 70, and the annular space 75 is formed in the in-shaft passage 61 by the outer peripheral surface of the valve element 70 and the paired seal members 72. The annular seal members 72 enhance hermeticity of the annular space 75 in the in-shaft passage 61, so that leakage of refrigerant gas from the annular space 75 to the in-shaft passage 61 and to the suction pressure region may be prevented.

The following will describe the compressor according to a second embodiment of the present invention. The compressor of the second embodiment is also mounted in a vehicle and used for a vehicle air conditioner but differs from the first embodiment in the configuration of the valve element 80. Like parts or elements are designated by like reference numerals and the description thereof will not be reiterated.

Figure 7A:
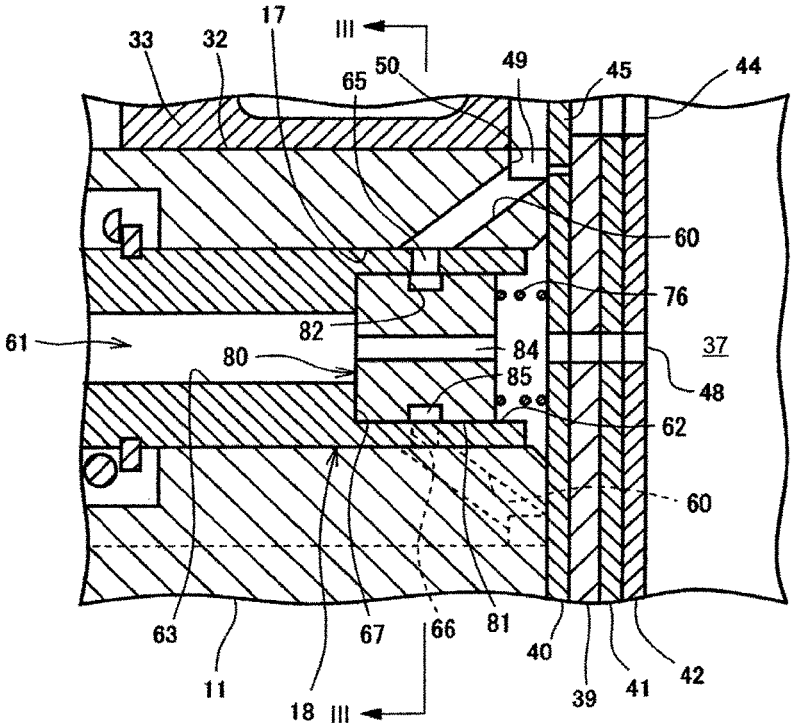
FIG. 7A is a partially enlarged longitudinal sectional view of the compressor according to a second embodiment.
Figure 7B:
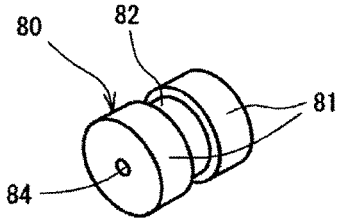
FIG. 7B is a perspective view of a valve element of the compressor according to the second embodiment.

Referring to FIGS. 7A and 7B, the valve element 80 is inserted in the large-diameter hole portion 62 of the in-shaft passage 61. The valve element 80 is axially and reciprocally movably mounted in the drive shaft 18. The valve element 80 of the present embodiment has an outer peripheral surface 81 and a groove 82 formed in the outer peripheral surface 81. The outer peripheral surface 81 has a diameter that is small enough to be inserted into the large-diameter hole portion 62 of the in-shaft passage 61. The outer peripheral surface 81 of the valve element 80 is provided with a coating layer (not shown) protecting against frictional wear caused by the sliding contact of the valve element 80 with the drive shaft 18. With the valve element 80 inserted in the large-diameter hole portion 62 of the in-shaft passage 61, the groove 82 forms an annular space 85 around the valve element 80. The valve element 80 has a valve hole 84 extending through the valve element 80 in the axial direction of the drive shaft 18 and opened at the opposite end surfaces of the valve element 80. The valve hole 84 serves as the throttle hole. The valve hole 84 is disposed coaxially with and in communication with the in-shaft passage 61, as well as with the suction pressure region.

According to the present embodiment, the valve element 80 is kept pressed to the step surface 67 by the urging force of the coil spring 76 at the maximum displacement. Thus, the annular space 85 is in communication with the high-pressure communication hole 65 and the low-pressure communication hole 66, so that the high-pressured residual gas in the high-pressured cylinder bore 32 is introduced into the low-pressured cylinder bore 32. At the maximum displacement, the residual gas bypass passage is fully opened. At the minimum displacement, the pressure difference between the pressure PC in the control pressure chamber 16 and the suction pressure PS is at a specific pressure or greater, and generates a force which is greater than the urging force of the coil spring 76, thereby to move the valve element 80 away from the step surface 67. In this state, the annular space 85 is not in communication with the high-pressure communication hole 65 and the low-pressure communication hole 66, so that the high-pressured residual gas in the high-pressured cylinder bore 32 is not flowed to the low-pressured cylinder bore 32. At the minimum displacement, the residual gas bypass passage is fully closed. In addition, the valve element 80 is movable by the pressure difference between the pressure PC in the control pressure chamber 16 and the suction pressure PS also at an intermediate displacement operation. When the pressure difference between the pressure PC in the control pressure chamber 16 and the suction pressure PS becomes at the specific pressure or greater, the valve element 80 shuts off fluid communication between the introduction passages 60 and the residual gas bypass passage. In other words, the high-pressured residual gas in the high-pressured cylinder bore 32 (32A) is not introduced to the low-pressured cylinder bore 32 (32D) when the pressure difference between the pressure PC in the control pressure chamber 16 and the suction pressure PS becomes at the specific pressure or greater.

The second embodiment offers substantially the same effects (1) through (5) of the first embodiment. In addition, the valve element 80 in which the annular space 85 is formed by the groove 82 in the valve element 80 requires no annular seal member such as 72 and no groove such as 73 for mounting of the annular seal member 72. Therefore, the production cost of the valve element 80 may be reduced.

The following will describe the compressor according to a third embodiment of the present invention. The compressor of the third embodiment is also mounted in a vehicle and used for a vehicle air conditioner but differs from the above-described embodiment in the shape of the valve element. Like parts or elements are designated by like reference numerals and the description thereof will not be reiterated valve element.

Figure 8A:
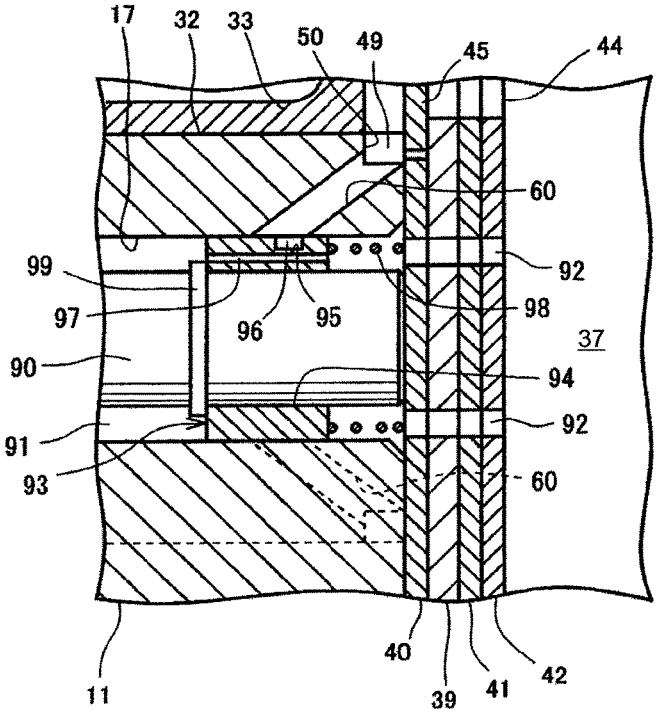
FIG. 8A is a partially enlarged longitudinal sectional view of the compressor according to a third embodiment.

Referring to FIG. 8A, the compressor of the third embodiment includes a drive shaft 90 which has a diameter considerably smaller than that of the shaft hole 17 and is inserted into the shaft hole 17. A space 91 is formed in the shaft hole 17 between the outer periphery of the drive shaft 90 and the inner peripheral surface of the cylinder block 11 forming the shaft hole 17. The space 91 is in communication with the control pressure chamber 16. Two holes 92 are formed through the valve plate 39, the valve forming plates 40, 41 and the retainer forming plate 42 at positions corresponding to the space 91. The space 91 and the holes 92 serve as the bleeding passage of the compressor.

Figure 8B:
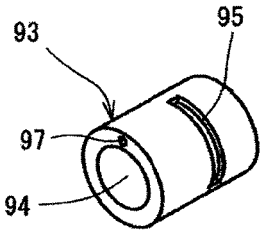
FIG. 8B is a perspective view of a valve element of the compressor according to the third embodiment.

A cylindrical valve element 93 is mounted on the drive shaft 90. As shown in FIG. 8B, the valve element 93 has an insertion hole 94 through which the drive shaft 90 is inserted. The insertion hole 94 of the valve element 93 has a diameter that is slightly greater than the outer diameter of the drive shaft 90, and the valve element 93 has an outer diameter that is slightly smaller than the diameter of the shaft hole 17. Although the valve element 93, which is mounted on the drive shaft 90, is movable in the direction of the axis of the drive shaft 90, the movement of the valve element 93 in circumferential direction of the drive shaft 90, or rotation relative to the drive shaft 90, is restricted by a rotation restriction member (not shown). Thus, the valve element 93 is rotatable integrally with the drive shaft 90. A groove 95 is formed in the outer peripheral surface of the valve element 93, extending in circumferential direction thereof. The groove 95 forms a space 96 providing a fluid communication between the high-pressured introduction passage 60 (60A) and the low-pressured introduction passage 60 (60D), so that the space 96 forms part of the residual gas bypass passage. The dimension of the groove 95 in circumferential direction of the valve element 93 is determined by the relative positions of the high-pressured introduction passage 60 (60A) and the low-pressured introduction passage 60(60D).

The valve element 93 has a valve hole 97 extending therethrough in axial direction of the drive shaft 18. Referring to FIG. 8A, the valve element 93 mounted on the drive shaft 90 divides the space 91 into a front portion and a rear portion, and the valve hole 97 provides a fluid communication between the front portion and the rear portion of the space 91. The valve hole 97 corresponds to the throttle hole, and especially serves the throttle hole for the bleeding passage. The valve hole 97 has a diameter that is smaller than the hole 92.

A coil spring 98 is interposed between the valve forming plate 40 and the valve element 93. The coil spring 98 is a compression spring and corresponds to an urging member that urges the valve element 93 toward a position in which the space 96 and the introduction passages 60 are brought into communication. The drive shaft 90 is formed with a stopper 99 that restricts the movement of the valve element 93 in the axial direction. When there is no significant pressure difference between the pressure PC in the control pressure chamber 16 and the suction pressure PS, the valve element 93 is pressed to the stopper 99 by the urging force of the coil spring 98. When the pressure difference between the pressure PC in the control pressure chamber 16 and the suction pressure PS becomes large and the force generated by the pressure difference becomes greater than the urging force of the coil spring 98, the valve element 93 is moved away from the stopper 99 to the position where the valve element 93 shuts off the fluid communication between the introduction passages 60 and the space 96.

At the maximum displacement operation, the valve element 93 is urged by the coil spring 98 to be positioned where the space 96 is in communication with the high-pressured introduction passage 60 (60A) and the low-pressured introduction passage 60 (60D). In this state, the high-pressured residual gas in the high-pressured cylinder bore 32 (32A) may be drawn into the low-pressured cylinder bore 32 (32D). At the maximum displacement operation, the residual gas bypass passage is fully opened. At the minimum displacement, the pressure difference between the pressure PC in the control pressure chamber 16 and the suction pressure PS becomes at the specific pressure or greater, so that the valve element 93 urged by the coil spring 98 is positioned where the valve element 93 shuts off the communication between the space 96 and the high-pressured introduction passage 60 (60A) and the low-pressured introduction passage 60 (60D). Thus, the high-pressured residual gas in the high-pressured cylinder bore 32 (32A) is not introduced into the low-pressured cylinder bore 32 (32D). At the minimum displacement operation, the residual gas bypass passage is fully closed. At the intermediate displacement operation, the valve element 93 is movable by the pressure difference between the pressure PC in the control pressure chamber 16 and the suction pressure PS. When the pressure difference between the pressure PC in the control pressure chamber 16 and the suction pressure PS becomes at the specific pressure or greater, the valve element 93 is moved to a position where it shuts off the communication between the space 96 and the high-pressured introduction passage 60 (60A) and the low-pressured introduction passage 60 (60D). In other words, when the pressure difference between the pressure PC in the control pressure chamber 16 and the suction pressure PS is at the specific pressure or greater in an intermediate displacement, the high-pressured residual gas in the high-pressured cylinder bore 32 is not flowed into the low-pressured cylinder bore 32. Therefore, the influence of the waveform of the pressure in the cylinder bore 32 is less likely to result in noise and the deterioration of COP and the leakage of the refrigeration gas from the cylinder bores 32 to the control pressure chamber 16 hardly occurs at the intermediate displacement.

The valve hole 97 serves as a throttle hole that sets the pressure difference across the valve element 93 in axial direction of the drive shaft 18 and also as a throttle hole in the bleeding passage that releases the refrigerant gas from the control pressure chamber 16 to the suction pressure region. Furthermore, no communication hole need to be formed inside the drive shaft 90 because the space 91 is formed in the shaft hole 17 between the outer peripheral surface of the drive shaft 90 and the inner peripheral surface of the cylinder block 11.

The following will describe the compressor according to a fourth embodiment of the present invention. The compressor of the fourth embodiment is also mounted in a vehicle and used for a vehicle air conditioner but differs from the above-described embodiment in the position of the coil spring. Like parts or elements are designated by like reference numerals and the description thereof will not be reiterated.

Figure 9:
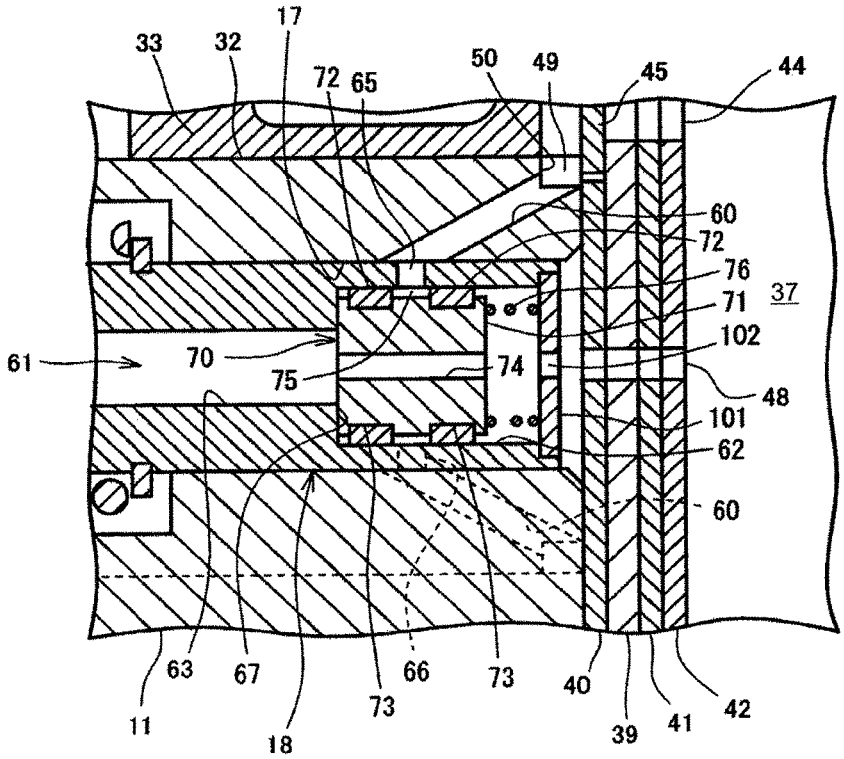
FIG. 9 is a partially enlarged longitudinal sectional view of the compressor according to a fourth embodiment.

Referring to FIG. 9, in the compressor of the fourth embodiment, the valve element 70 is inserted in the large-diameter hole portion 62 of the drive shaft 18. The drive shaft 18 includes a cover 101 that closes the opening of the large-diameter hole portion 62. The cover 101 has at the center thereof a hole 102 having substantially the same diameter as the valve hole 74 of the valve element 70. In this embodiment, the coil spring 76 is held between the valve element 70 and the cover 101 in compressed state, so that the coil spring 76 is accommodated in the large-diameter hole portion 62. The coil spring 76 rotates with the drive shaft 18, so that sliding contact does not occur between the coil spring 76 and the parts around the coil spring 76, such as the main body 71, the cover 101, and the drive shaft 18. It is to be noted that an engaging member may be provided in at least one of valve element 70 and the cover 101 for mounting the coil spring 76.

The fourth embodiment offers substantially the same effects as the first embodiment. In addition, according to the fourth embodiment, the coil spring 76 is free from sliding contact with the parts around the coil spring 76 with the rotation of the drive shaft 18, and hence free from frictional wear which may be caused by sliding movement relative to the drive shaft 18. Thus, the reliability of the compressor is increased.

The present invention is not limited to the above-described embodiments, but may be modified in various manners within the scope of the invention, as exemplified below.

The bleeding passage need not necessarily be formed by utilizing the communication hole formed in the drive shaft or the space formed around the drive shaft as in the above-described embodiments. For example, a plurality of bleeding passages may be formed, one formed in the cylinder block, in addition to the bleeding passage formed by utilizing the communication hole in the drive shaft or the space around the drive shaft.

Although the space providing a fluid communication between the introduction passages is formed extending over the entire circumference around the outer periphery of the valve element in the first and second embodiments, the space may be formed around a part of the circumference of the valve element as in the third embodiment. In this case, the dimension of the space in circumferential direction of the valve element may be determined based on the positional relation between the high-pressure communication hole and the low-pressure communication hole, and a rotation restriction member for restricting the rotation of the valve relative to the drive shaft may be added.

Although a rotation restriction member is not used in the first, second and fourth embodiment for restricting the rotation of the valve, any suitable rotation restriction member may be provided in the valve element so as to rotate integrally with the drive shaft.

The low-pressure communication hole may be connected to the cylinder bore in its suction phase instead of the cylinder bore in its compression phase.

The communication passages may be formed in the rear housing or other parts of the compressor if the valve mechanism is disposed projecting out from the rear end of the cylinder block. If the valve mechanism is disposed outward of the rear end of the cylinder block in axial direction of the drive shaft, the introduction passage may be formed in the rear housing or other parts.

The application of friction reduction coating is not limited to the part of the coil spring that is in contact with the valve element, but the friction reduction coating may be applied to the end surface of the valve element that is in contact with the coil spring.

A plane bearing may be added between the coil spring and the valve element to hold the coil spring against rotation of the coil spring.

The application of the compressor of the present invention is not limited to a compressor of a vehicle air conditioner.

What is claimed is:

1. A variable displacement type swash plate compressor comprising:

a housing having therein a suction chamber, a discharge chamber, a control pressure chamber in communication with the suction chamber, a shaft hole, and a plurality of cylinder bores disposed around the shaft hole;

a drive shaft inserted into the shaft hole and rotatably supported in the housing;

a swash plate accommodated in the control pressure chamber and rotatable with the drive shaft;

an inclination angle changing mechanism permitting changing of an inclination angle of the swash plate with respect to an imaginary plane extending perpendicular to an axis of the drive shaft;

a plurality of pistons received in the respective cylinder bores and connected to the swash plate, the pistons being reciprocally movable with the rotation of the drive shaft;

a plurality of introduction passages connecting the shaft hole and the respective cylinder bores; and a valve mechanism having a residual gas bypass passage that introduces a high-pressured residual gas in one of the cylinder bores into another of the cylinder bores having a pressure lower than the one of the cylinder bores through the introduction passages, wherein the valve mechanism has a valve element that is mounted to the drive shaft and is disposed in a passage connecting the control pressure chamber and the suction chamber, wherein the valve element is integrally rotatable with the drive shaft and movable in a direction of the axis of the drive shaft by a pressure difference across the valve element, wherein an opening of the residual gas bypass passage is changed by the movement of the valve element in the direction of the axis of the drive shaft, and the valve element selectively connects and disconnects the introduction passages with the residual gas bypass passage with the rotation of the drive shaft.

2. The variable displacement type swash plate compressor according to claim 1, wherein the opening of the residual gas bypass passage that is changed by the movement of the valve element is variable in accordance with a displacement of the compressor.

3. The variable displacement type swash plate compressor according to claim 1, wherein the valve element is inserted in an in-shaft passage formed inside the drive shaft, wherein the drive shaft has therein a plurality of communication holes, and wherein the introduction passages are communicable with the residual gas bypass passages through the communication holes.

4. The variable displacement type swash plate compressor according to claim 1, wherein the valve element has a throttle hole that provides a fluid communication between the control pressure chamber and the suction chamber.

5. The variable displacement type swash plate compressor according to claim 1, wherein a space communicable with the introduction passages is formed around the outer periphery of the valve element.

6. The variable displacement type swash plate compressor according to claim 1, wherein the valve element has an insertion hole through which the drive shaft is inserted.

* * * * *